US011328698B2

(12) United States Patent
Sikra

(10) Patent No.: US 11,328,698 B2
(45) Date of Patent: May 10, 2022

(54) MULTIPIECE DRUM LUG

(71) Applicant: Drum Workshop, Inc., Oxnard, CA (US)

(72) Inventor: Rich Sikra, Thousand Oaks, CA (US)

(73) Assignee: Drum Workshop, Inc., Oxnard, CA (US)

( * ) Notice: Subject to any disclaimer, the term of this patent is extended or adjusted under 35 U.S.C. 154(b) by 0 days.

(21) Appl. No.: 17/147,274

(22) Filed: Jan. 12, 2021

(65) Prior Publication Data

US 2021/0217390 A1 Jul. 15, 2021

Related U.S. Application Data

(60) Provisional application No. 62/960,635, filed on Jan. 13, 2020.

(51) Int. Cl.
*G10D 13/16* (2020.01)
*G10D 13/02* (2020.01)

(52) U.S. Cl.
CPC ..... *G10D 13/16* (2020.02); *G10D 13/02* (2013.01)

(58) Field of Classification Search
CPC ..... G10D 13/16; G10D 13/02
See application file for complete search history.

(56) References Cited

U.S. PATENT DOCUMENTS

| | | | | | |
|---|---|---|---|---|---|
| 2,092,980 | A * | 9/1937 | Ludwig | G10D 13/16 | 84/411 R |
| 2,172,578 | A * | 9/1939 | Gladstone | G10D 13/02 | 84/411 R |
| 4,122,747 | A * | 10/1978 | Yamashita | G10D 13/16 | 84/411 R |
| 4,790,229 | A * | 12/1988 | Hoshino | G10D 13/02 | 84/413 |
| 6,700,045 | B2 * | 3/2004 | Del Valhe | G10D 13/16 | 84/413 |
| 7,119,263 | B1 * | 10/2006 | Chen | G10D 13/02 | 84/411 A |
| 7,291,777 | B2 * | 11/2007 | Chen | G10D 13/16 | 84/421 |
| 7,402,740 | B2 * | 7/2008 | van der Meulen | G10D 13/16 | 84/413 |
| 9,679,545 | B1 * | 6/2017 | Chen | G10D 13/02 | |
| 9,934,765 | B2 * | 4/2018 | Chandontrikij | G10D 13/02 | |
| 10,497,345 | B2 * | 12/2019 | Pawlovich | G10D 13/22 | |
| 2021/0217390 | A1 * | 7/2021 | Sikra | G10D 13/02 | |

* cited by examiner

*Primary Examiner* — Robert W Horn
(74) *Attorney, Agent, or Firm* — Ferguson Case Orr Paterson

(57) ABSTRACT

Described herein are multipiece drum lugs and drum lug assemblies for use with percussion instruments such as drums. The drum lugs can include a separate base and a separate cap that can be interlocked, along with an insert to prevent rotation and disconnection. Receivers can be placed in the lug prior to the connection of the base and cap and sandwiched therebetween. Such a lug assembly can enable the use of regular size tension rods on drums having a relatively small depth.

20 Claims, 6 Drawing Sheets

MULTIPIECE DRUM LUG

CROSS-REFERENCE TO RELATED APPLICATION

This application claims the priority benefit of U.S. Provisional Pat. App. No. 62/960,635 to Sikra, filed on Jan. 13, 2020 and entitled "Multipiece Drum Lug," which is fully incorporated by reference herein in its entirety.

BACKGROUND OF THE DISCLOSURE

Field of the Disclosure

This disclosure relates generally to percussion instruments, such as tom toms and snare drums, that include drum lugs. More particularly, this disclosure relates to drum lugs comprising multiple different pieces, and even more particularly, to multipiece drum lugs for use with shallow drums such as piccolo drums and popcorn snare drums.

Description of the Related Art

FIG. 1A shows a prior art snare drum 100. The snare drum 100 includes a sidewall 102, a top head 104, a bottom head (not shown), a drum hoop 106, drum lugs 108 each including a lug base 108*a* and a lug cap 108*b*, lug receivers 110, and tension rods 112. The drum head 104 is held onto the sidewall 102 by the drum hoop 106. Tension rods 112 pass through the drum hoop 106 and then connect to the receivers 110, such as via screwing. The lug bases 108*a* are attached to the sidewall 102 and the receivers 110 are connected to the lug caps 108*b*. Each receiver 110 can be fixed with its respective lug, or can pass through the outside of the lug such that its end is within a hollow inside of the lug. The tighter that the tension rods 112 are screwed (that is, the further they are screwed into the receivers 100) the more tension is in the head 104 (or, when adjusting the bottom tension rods, the bottom head). The amount of tension in the head 104 affects the sound produced by the drum 100.

The lug 108 is a "turret lug," made famous by Drum Workshop, Inc. of Oxnard, Calif. The base 108*a* has a circular cross-section, and the cap 108*b* has a circular cross-section with a smaller diameter than the base 108*a*. As can be seen in this specific embodiment, the cap 108*b* has a smaller diameter than the base 108*a* where the two portions meet one another, such that the cap 108*b* "sits on" the base 108*a*.

It is beneficial for the receivers 110 to not be fixed to the lug 108. Use of fixed receivers (e.g., receivers that are cast as part of the lug, or that are stiffly attached to the lug without the ability to positionally adjust) often causes misalignment and binding of the threading between the receivers and the tension rods, because the receivers and tension rods are typically not exactly aligned with one another. Thus, with fixed receivers, the user is often forced to choose between either 1) not using a significant portion of the available threading (e.g., not screwing the tension rods in as much as they otherwise would), which leads to loose tension rods that can unscrew and cause a loss of tuning; or 2) forcefully screwing the tension rod into the fixed receiver, exacerbating the misalignment and causing mechanical and tuning problems. Thus, it is desirable to use receivers that "float," and can move slightly so as to align with the tension rods.

The drum 100 in FIG. 1A is a regular size snare drum. Typically, regular size snare drums have about a 14 inch diameter and are about 5-7 inches deep. With this size drum, it is mechanically simple to use large lugs with large hollow insides. FIGS. 1B-1D show rear views of such a lug 150 and receivers 152, which can be similar to or the same as the lugs 108 and receivers 110 from FIG. 1A. Additionally, FIGS. 1B-1D show stopper inserts 154. To allow the receivers 152 to float, they pass through the lug 150 (most commonly through the lug cap) to a hollow inside of the lug 150. The hollow inside in this specific embodiment includes a portion 150*a* corresponding to the lug base, and a cutout portion 150*b* which corresponds to the depth of the lug cap. As shown in FIG. 1C, the receiver can be placed into the cutout portion 150*b* and through the lug 150 such that the tube portion of the receiver 152 is outside of the lug 150, as shown. The stopper insert 154 can then be inserted to hold the receiver 152 in place. Because the hole in the lug 150 through which the receiver 152 passes has a larger cross-section than the receiver tube portion, the receiver 152 is held loosely instead of tightly to the lug 150, and thus is not fixed and can adjust to its respective tension rod. FIG. 1D shows both receivers 152 and stopper inserts 154 in place. The lug 150 is typical of a snare drum, which is typically "double-tensioned"—that is, tension rods attach to the lug from both the top and bottom. Other types of lugs where a tension rod only connects to one side of the lug are also common.

Typical tension rods have a length of about 1 to 2 inches and a diameter of about 5/32" to 1/4". While the lug 150 can be used with regular size drums such as the snare drum 100 and regular size tension rods, other drums such as piccolo drums (typical approximate depth of 3 to 4.5 inches) and shallower popcorn snare drums have less depth (i.e., are shallower) than the snare drum 100, and as such smaller lugs should be used. However, with smaller lugs there is not enough room internally for the receivers, and as such fixed receivers (instead of floating receivers) are used. This is especially true of circular (or similarly-shaped, e.g., oval-shaped) lugs such as turret lugs (e.g., the lugs 108,150), and results in the previously described disadvantages.

SUMMARY OF THE DISCLOSURE

The present disclosure relates to drum lugs, drum lug assemblies, and drums including lug assemblies. Particularly, the disclosure relates to multipiece drum lugs, drum lug assemblies with multipiece lugs, and drums including lug assemblies with multipiece lugs.

One embodiment of a drum lug according to the present disclosure includes a base and a cap rotationally interlocked with the base. The lug also includes an insert in a hollow inside formed by the base and the cap, the insert preventing rotation of the base and cap relative to one another.

One embodiment of a drum lug assembly according to the present disclosure includes a drum lug and first and second receivers. The lug includes a base and a cap rotationally interlocked with the base. The lug also includes an insert in a hollow inside formed by the base and the cap, the insert preventing rotation of the base and cap relative to one another. Each of the first and second receivers is at least partially in a hollow inside of the lug and at least partially outside the lug.

One embodiment of a method of forming a drum lug assembly according to the present disclosure comprises placing first and second receivers at least partially in a hollow inside of a lug cap, and connecting a lug base to the lug cap so as to sandwich the receivers between the lug base and lug cap. The method further includes rotating the lug cap and/or lug base relative to one another so as to interlock the two. The method further includes placing an insert into a hollow inside formed by the base and cap, the insert preventing rotation of the base and cap relative to one another.

This has outlined, rather broadly, the features and technical advantages of the present disclosure in order that the detailed description that follows may be better understood. Additional features and advantages of the disclosure will be described below. It should be appreciated by those skilled in the art that this disclosure may be readily utilized as a basis for modifying or designing other structures for carrying out the same purposes of the present disclosure. It should also be realized by those skilled in the art that such equivalent constructions do not depart from the teachings of the disclosure as set forth in the appended claims. The novel features, which are believed to be characteristic of the disclosure, both as to its organization and method of operation, together with further features and advantages, will be better understood from the following description when considered in connection with the accompanying figures. It is to be expressly understood, however, that each of the figures is provided for the purpose of illustration and description only and is not intended as a definition of the limits of the present disclosure.

DETAILED DESCRIPTION OF THE DISCLOSURE

Figure 1A:
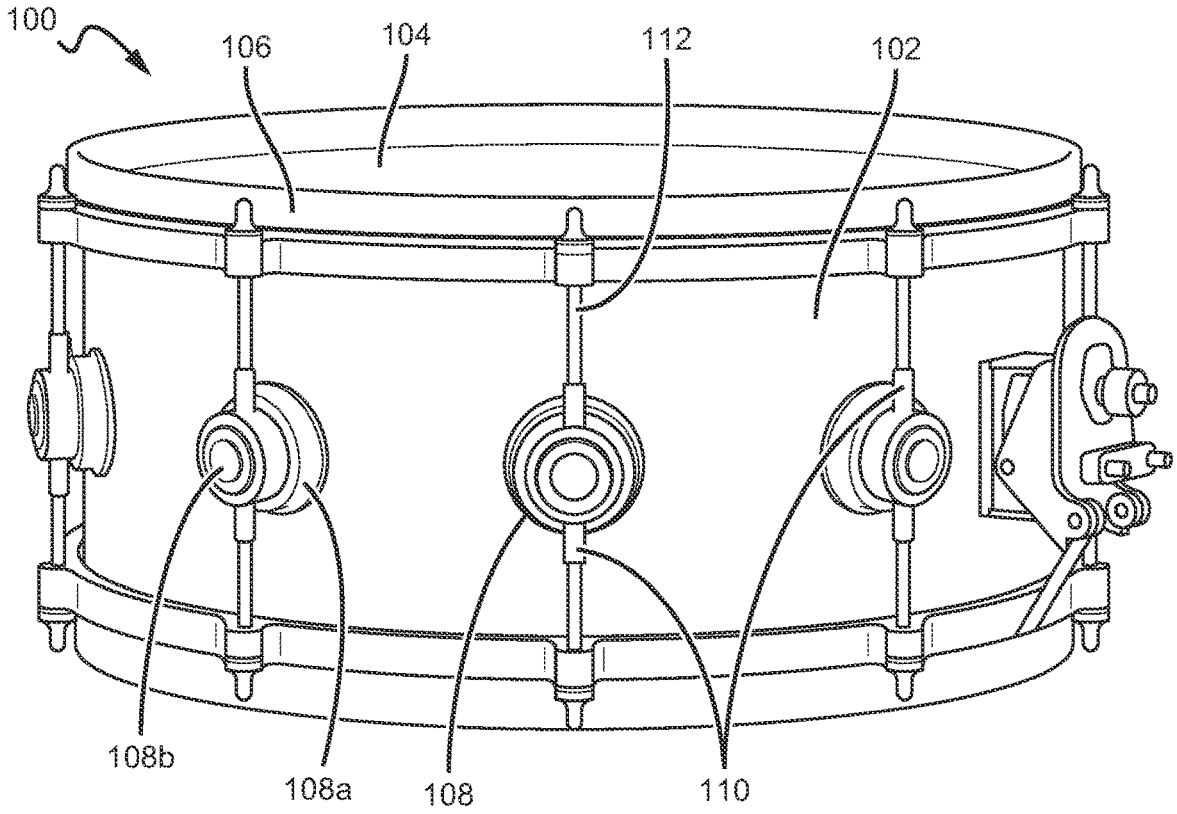
FIG. 1A PRIOR ART
FIG. 1A is a perspective view of a prior art snare drum.
Figure 1B:
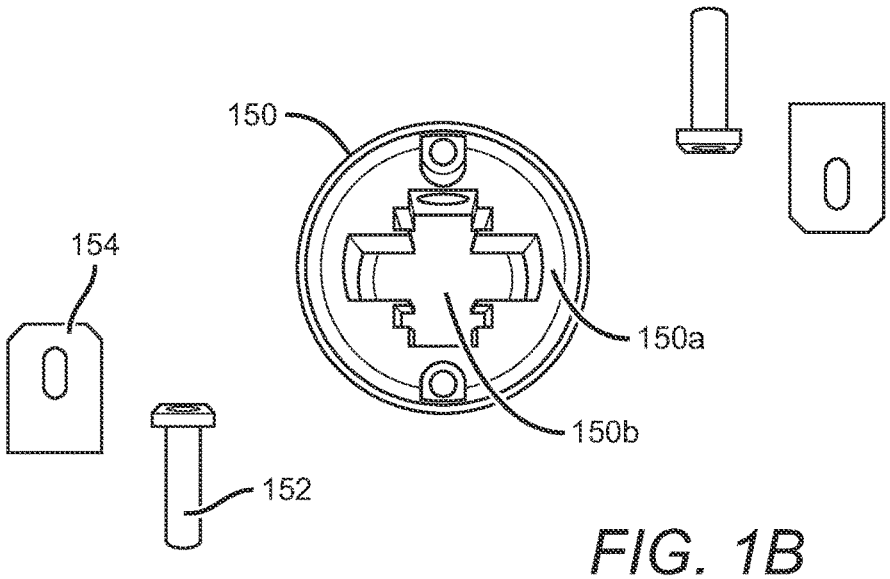
FIG. 1B PRIOR ART
FIGS. 1B-1D are rear views of a prior art drum lug with receivers and stopper inserts.
Figure 1C:
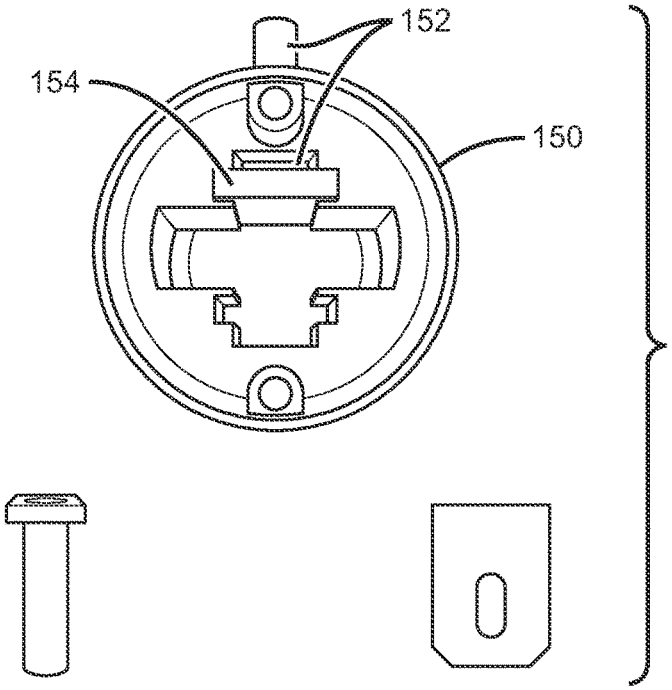
FIG. 1C PRIOR ART
Figure 1D:
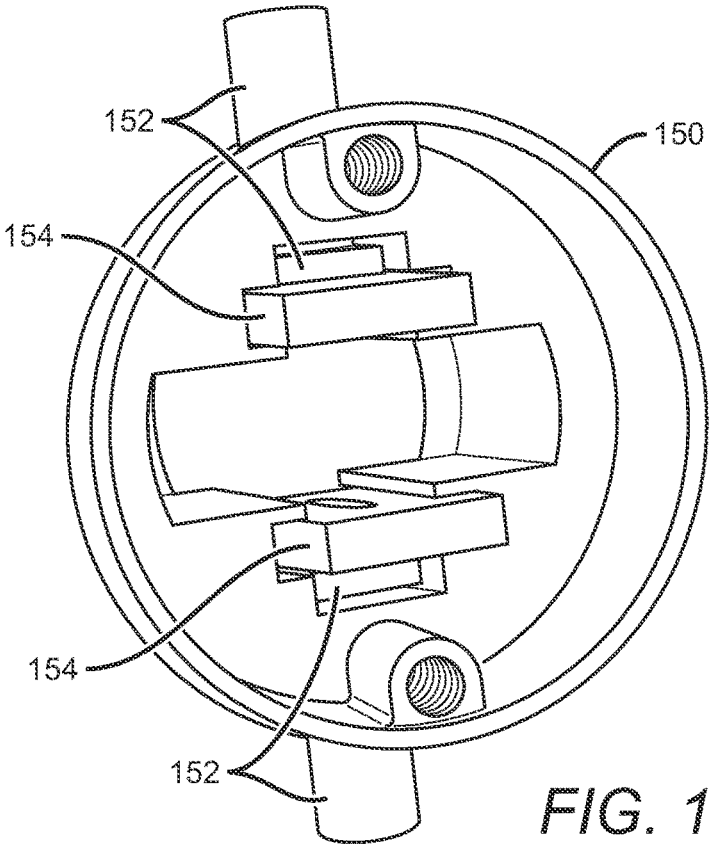
FIG. 1D PRIOR ART
Figure 2:
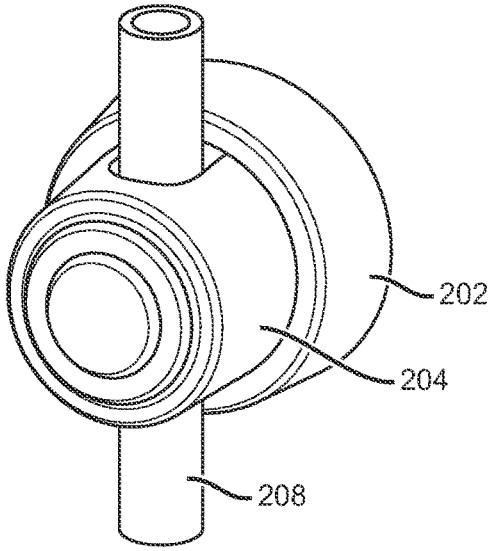
FIG. 2 is a perspective view of a drum lug with receivers according to one embodiment of the present disclosure.

The present disclosure relates to percussion instruments and drums, and particularly to drums, and even more particularly to drum lugs and drum lug assemblies, although it is understood that the concepts, components, systems, and methods described herein can be applied to other areas. Drum lugs according to the present disclosure can include multiple pieces, and in some embodiments three or more pieces. For instance, one embodiment includes a lug base and a lug cap that are separable from one another, as well as a lug insert. While separated, one or more receivers can be placed into the lug cap, and then the lug base and lug cap can be connected so as to sandwich the receivers therebetween. The lug base and lug cap can then be rotated relative to one another so as to interlock, and the insert can be placed into the remaining hollow inside area so as to lock the base and cap into place relative to one another so that they cannot rotate so as to be able to disconnect from one another. This assembly allows for traditional floating receivers to be used instead of fixed receivers. The receivers in lug assemblies according to the present disclosure have distinct advantages over prior art fixed receivers, in that the receivers according to the present disclosure float so as to better adjust to tension rod location, and are longer so as to provide for a more secure connection and lessen the chances of accidental unscrewing since more threads are engaged.

It is understood that when an element is referred to as being "on" another element, it can be directly on the other element or intervening elements may also be present. Similarly, if an element is "attached to," "connected to," or similar, another element, it can be directly attached/connected to the other element or intervening elements may also be present. Furthermore, relative terms such as "inner", "outer", "upper", "top", "above", "lower", "bottom", "beneath", "below", and similar terms, may be used herein to describe a relationship of one element to another. Terms such as "higher", "lower", "wider", "narrower", and similar terms, may be used herein to describe angular and/or relative relationships. It is understood that these terms are intended to encompass different orientations of the elements or system in addition to the orientation depicted in the figures.

Although the terms first, second, etc., may be used herein to describe various elements, components, regions and/or sections, these elements, components, regions, and/or sections should not be limited by these terms. These terms are only used to distinguish one element, component, region, or section from another. Thus, unless expressly stated otherwise, a first element, component, region, or section discussed below could be termed a second element, component, region, or section without departing from the teachings of the present disclosure.

Embodiments of the disclosure are described herein with reference to view illustrations that are schematic illustrations. As such, the actual thickness of elements can be different, and variations from the shapes of the illustrations as a result, for example, of manufacturing techniques and/or tolerances are expected. Thus, the elements illustrated in the figures are schematic in nature and their shapes are not intended to illustrate the precise shape of a region and are not intended to limit the scope of the disclosure.

FIGS. 2-7 show various views of drum lug assemblies and/or components thereof according to the present disclosure. A lug 200 includes a base 202, a cap 204, and an insert 206. The lug assembly can include additional components such as receivers 208 (also referred to as receiver nuts) and tension rods 210 (also referred to as tension rod bolts). The lug base 202 can include screw holes 202*d* which can be used to attach the lug 200 to a drum sidewall, or other methods of attachment as known in the art can be used.

Figure 7:
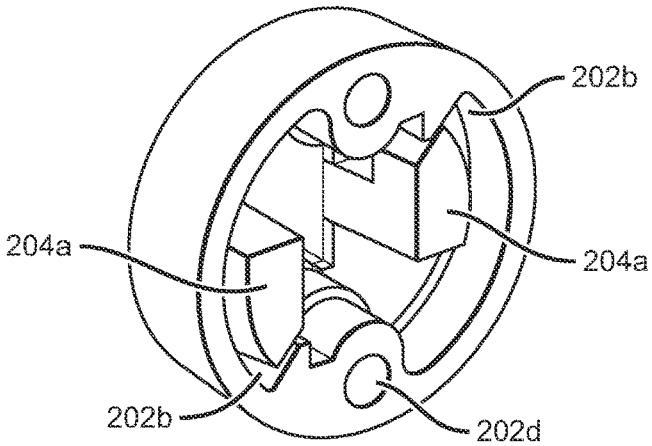
FIG. 7 is a rear perspective view of a portion of the drum lug shown in FIG. 1.
Figure 6:
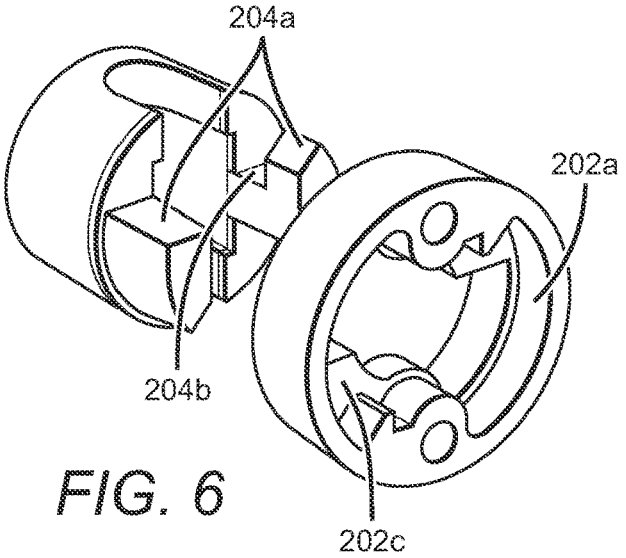
FIG. 6 is an exploded view of a portion of the drum lug shown in FIG. 1.

In this embodiment of the present disclosure, the base 202 and cap 204 are separate components, as opposed to the prior art base and cap 108*a*,108*b* that are integral with one another and/or monolithic. The base 202 includes a hollow inside 202*a*, while the cap 204 includes rearward extending protrusions 204*a*. As shown by FIGS. 6 and 7, the cap 204 can be placed into the base 202 such that the protrusions 204*a* extend into the hollow inside 202*a* of the base 202. The base 202 and cap 204 are shaped to interlock with one another such that they cannot be separated by linear movement, such as linear movement away from one another (i.e., from the perspective of FIG. 3, into and out of the page; from the perspective of FIG. 4, up and down on the page). To form this interlocking connection, after insertion of the cap 204 into the base 202, one or both of the components are rotated such that the protrusions 204*a* of the cap fit into the cutouts 202*b* of the base, and the protrusions 202*c* of the base fit into the cutouts 204*b* of the cap. The base 202 and cap 204 are thus interlocked, in this specific embodiment by a rotational male-female cap-base connection and a rotational male-female base-cap connection. The base 202 and cap 204 are thus interlocked such that they are not separable by movement normal to the plane of rotation. For instance, rearward movement of the protrusions 202*c* can be blocked by the protrusions 204*a*, and forward movement of the protrusions 204*a* can be blocked by the protrusions 202*c*. To be separated, the base 202 and/or cap 204 must be rotated to break the interlock before movement normal to the plane of rotation can occur to separate the pieces.

Figure 3:
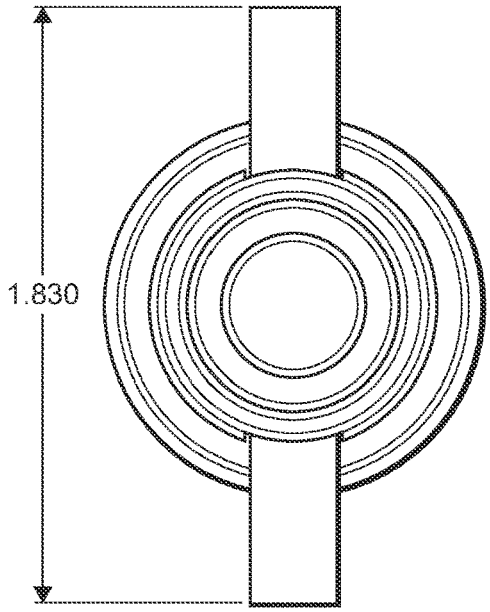
FIG. 3 is a front view of the drum lug with receivers shown in FIG. 2.
Figure 4:
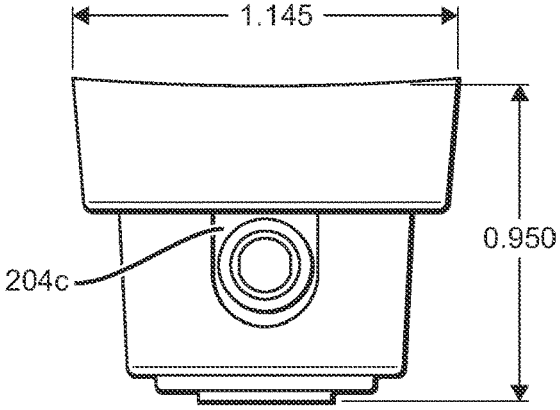
FIG. 4 is a top view of the drum lug shown in FIG. 2.

FIGS. 3 and 4 show exemplary dimensions of the lug 200 and the combination of the lug 200 and receivers 208, in inches (though it is understood that the sizes of the components could be adapted to any size, for instance, such that the shown dimensions were in centimeters). These dimensions are exemplary in nature, and it is understood that variations of these dimensions, both proportionally and disproportionately, are possible. For example, any one of the three dimensions shown, any two of the three dimensions shown, or all three of the dimensions shown can be less than or greater than the shown dimensions by 10%, 20%, 30%, 50%, 65%, 75%, or more; and greater than the shown dimensions by 100% or more.

Lugs having small dimensions, such as the dimensions of the lug shown in FIGS. 3 and 4, cannot mechanically have normal-size receivers and tension rods inserted in the normal manner as described with regard to FIGS. 1A-1D. As such, fixed receivers are often used, which cause the previously described problems.

Assembly of a Lug Assembly with the Lug 200

Figure 8A:
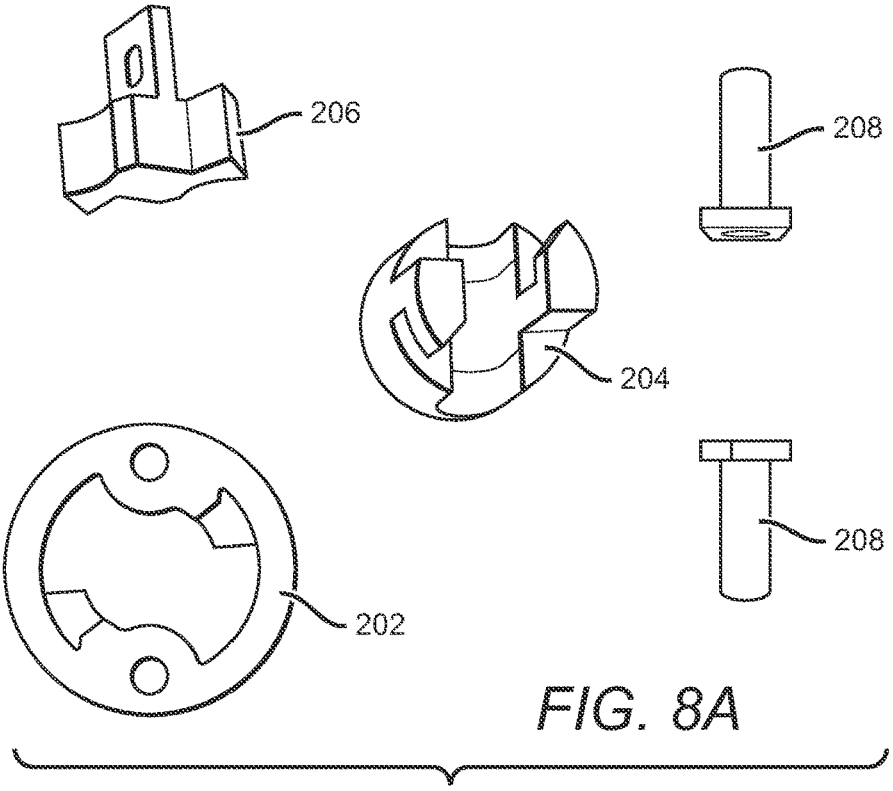
FIGS. 8A-8F show various steps of the assembly of a lug assembly including components shown in FIGS. 2-7.
Figure 8B:
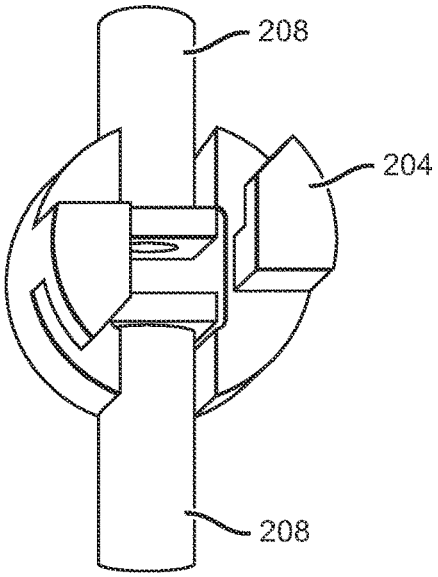

The multipiece structure of the lug 200, on the other hand, permits the insertion of the receivers 208. Assembly of such an assembly is shown in FIGS. 8A-8F. FIG. 8A shows the components of the lug assembly, including lug base 202, lug cap 204, lug insert 206, and two receivers 208. In FIG. 8B, prior to the base 202 and cap 204 being connected, the two receivers 208 are placed in the hollow inside of the cap 204 such that the tube of each receiver 208 protrudes through a respective cap aperture 204*c*. The bottom receiver 208 is prevented from falling out (e.g., due to gravity) by its base abutting a portion of the cap 204 (e.g., because the receiver base has a larger diameter than its respective cap aperture 204*c*). In other embodiments, elements known in the art such as stopper inserts (such as stopper inserts 154 discussed above) could be used. Many different embodiments are possible.

Figure 8C:
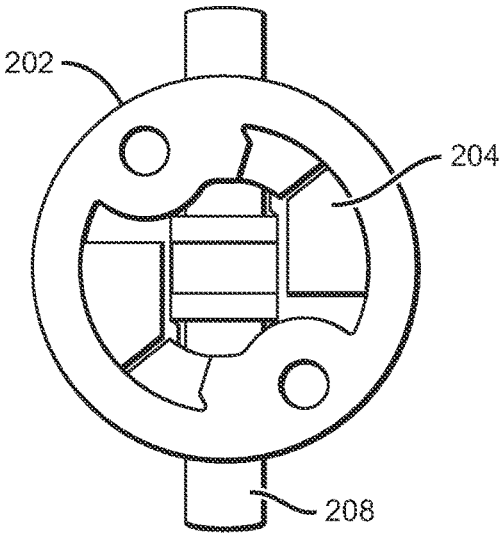
Figure 8D:
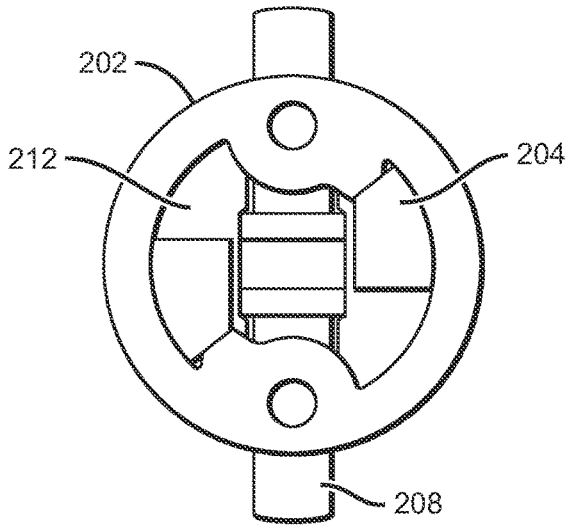

The base 202 and cap 204 are then connected to one another, sandwiching the receivers 208 therebetween as shown in FIG. 8C. One or both of the base 202 and cap 204 are then rotated so as to interlock the two pieces, as shown in FIG. 8D. It is understood that the receivers 208 could instead be placed into or on the base 202 before the connection step (as opposed to into the cap), with the cap 204 then being connected to the base 202 in a manner such that the tube of each receiver 208 protrudes through a respective cap aperture 204*c*.

The lug insert 206 includes a main body 206*a* and a protrusion 206*b*. The protrusion 206*b* is shaped to fit between the two receivers 208, so as to provide a base for both receivers 208 and prevent the top receiver 208 from falling downward. The body 206*a* of the protrusion is shaped to fit into the remaining hollow area 212 (FIGS. 8E and 8F) that remains after the base 202 and cap 204 have been interlocked, which completes the puzzle by substantially filling the remaining hollow area 212, and substantially prevents rotation of the base 202 and cap 204 relative to one another. Thus, the base 202 and cap 204 cannot be separated from one another until the lug insert 206 is removed. The lug 200 as a whole can be shaped so as to form a substantially solid and approximately planar rear surface as shown (which, for example, could be planar, or could include a slight curve, e.g., to fit the curve of the drum sidewall), which can include portions of all three components—the base 202, cap 204, and insert 206, as shown. The rear surfaces of the base 202, cap 204, and insert 206 can be substantially coplanar with one another.

Use a Lug Assembly with the Lug 200

Figure 8F:
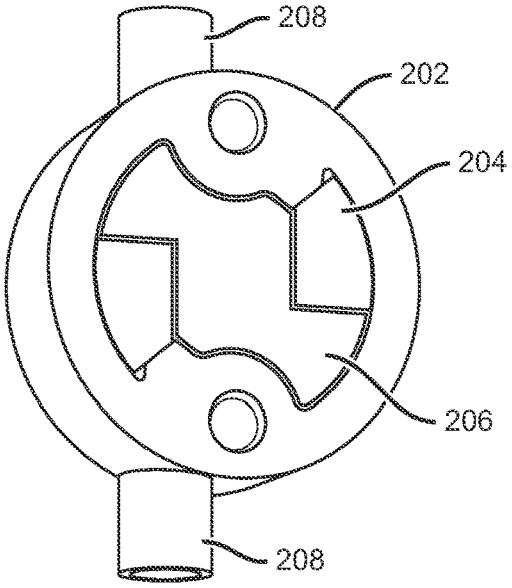

The lug assembly shown in FIG. 8F can be attached to a drum sidewall using the screw holes 202*d*, or using other methods as known in the art.

Figure 5:
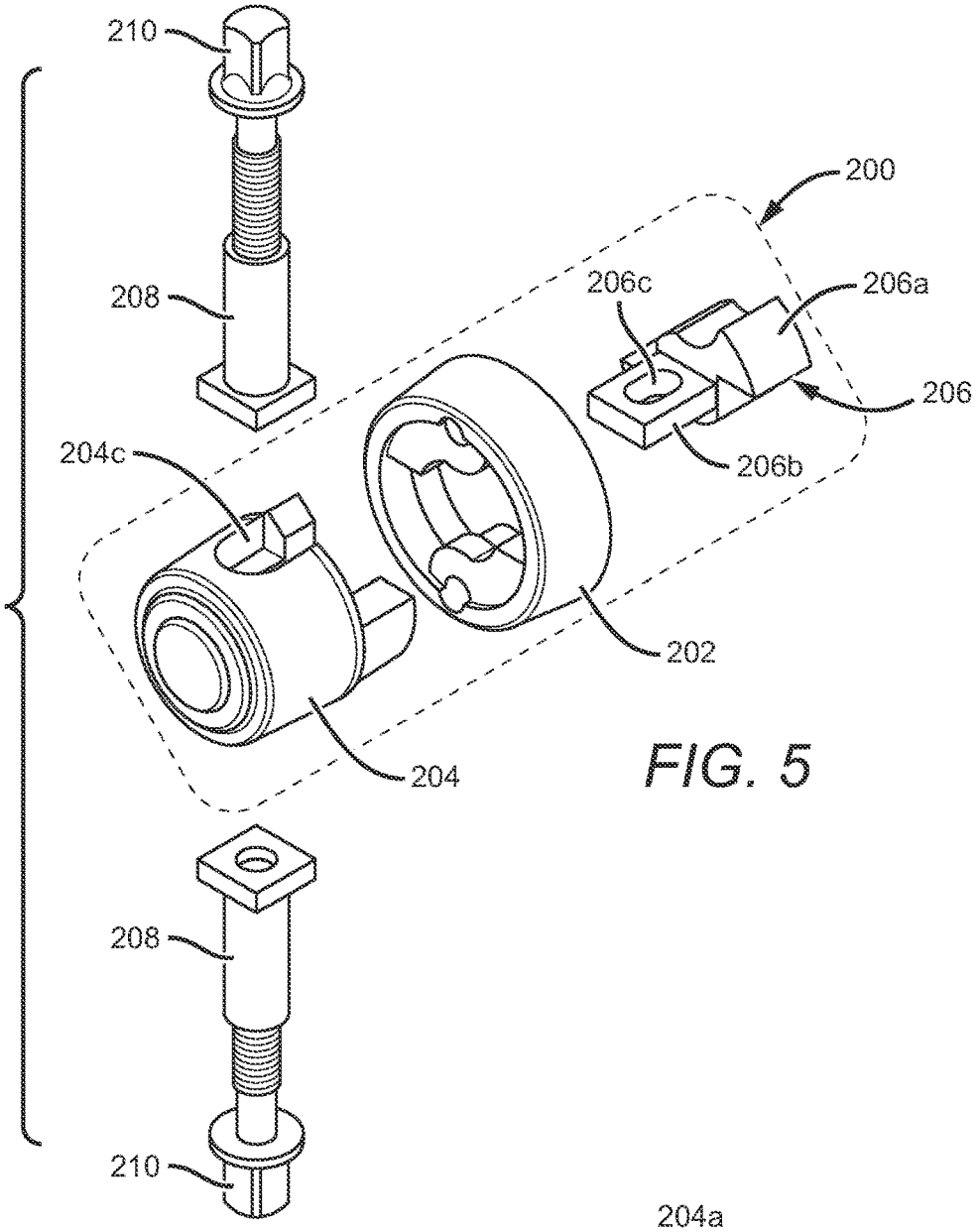
FIG. 5 is an exploded view of the drum lug with receivers shown in FIG. 1, with tension rods.

As best seen in FIGS. 4 and 5, the cap apertures 204*c* have a cross-section that is larger than that of the tubes of the receivers 208. The cap apertures 204*c* can have a cross-sectional area that is 5% or more, 10% or more, 20% or more, 30% or more, 50% or more, 60% or more, 75% or more, or 100% or more greater than the cross-sectional area of the receiver tubes. The cap apertures 204*c* may also have a non-circular cross-sectional shape, such as a rectangle, oval, or other shape as known in the art. For instance, in the specific embodiment shown, the cap apertures 204*c* have a shape that is approximately the combination of a rectangle and semicircle. Both the width (left-to-right in FIG. 4) and length (from bottom-to-top in FIG. 4) of the cap apertures 204*c* can be larger than the diameter of the receiver tubes. For instance, in this specific embodiment, the diameter of the aperture semicircle (and thus the aperture itself) is approximately 5/16" while the diameter of the receiver tube is sized for the tension rod (e.g., approximately 1/4" receiver tube diameter), so the width of the aperture is approximately 1/16" larger than the width of the tube. In some embodiments, the width of the aperture can be 1/32" larger, 1/16" larger, 3/32" larger, 1/8" larger, 3/16" larger, 1/4" larger, 1/2" larger, or even further larger than the width of the tube. Embodiments such as these allow for the receivers 208 to move so as to adjust to tension rods 210, which has the benefits previously described. It is understood that these dimensions are exemplary in nature, and many different embodiments are possible.

Figure 8E:
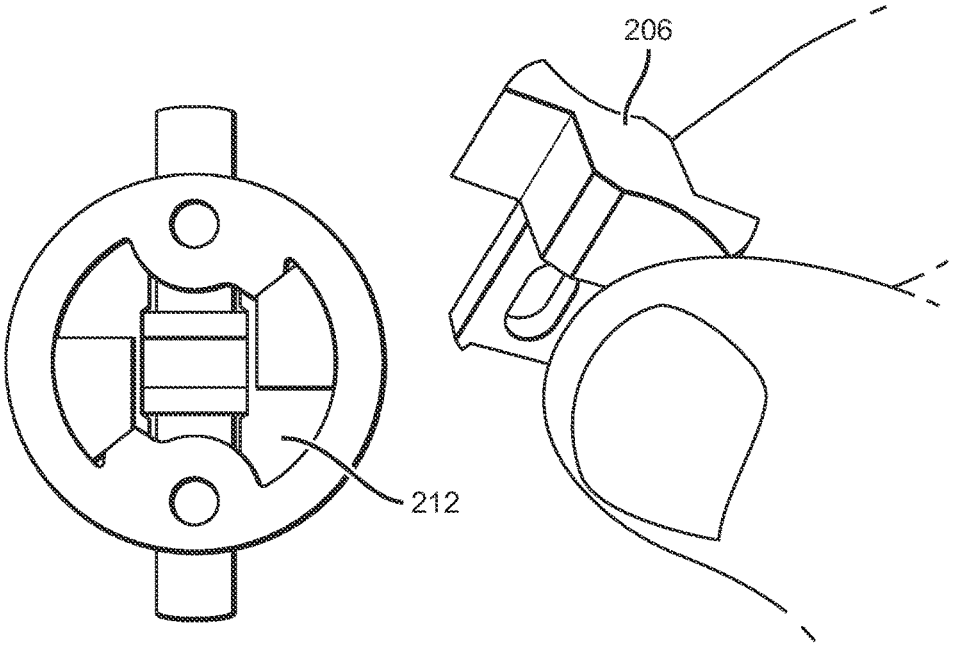

Placement of the receivers 208 within the hollow inside of the lug 200 also has benefits in that it provides for a longer threaded connection between the tension rods 210 and the receivers 208. The threaded connection does not end where the tension rod 210 enters the cap 204; instead, it continues further into the cap 204, since as can be seen in FIG. 8E, the receivers 208 go into the hollow inside of the cap. In embodiments having the dimensions shown in FIGS. 3 and 4, the receivers 208 can be greater than 1/2" long, approximately 5/8" long or longer, approximately 3/4" long or longer, approximately 1" long or longer, or even longer, though it is understood that shorter embodiments are also possible. In prior art lug assemblies having dimensions similar to those of FIGS. 3 and 4, the receivers are approximately 1/2". The extra length provided by receivers according to the present disclosure provides a more secure connection between receiver and tension rod that is less likely to unintentionally loosen (which causes a drum to go out of tune). Additionally, the insert protrusion 206*b* can be shaped to define a hole 206*c* into which one or more tension rods 210 could enter and/or pass through.

While the present disclosure specifically describes a double-tensioned embodiment including top and bottom receivers, it is understood that other embodiments, such as but not limited to single-receiver embodiments, are possible, as would be understood by one of skill in the art based on this disclosure. Additionally, while the present disclosure specifically describes a lug having one base and one cap, it is understood that other lug pieces may be present, such as one or more intermediate pieces between the base and the cap, as would be understood by one of skill in the art based on this disclosure.

It is understood that embodiments presented herein are meant to be exemplary. Embodiments of the present disclosure can comprise any combination of compatible features shown in the various figures, and these embodiments should not be limited to those expressly illustrated and discussed.

Although the present disclosure has been described in detail with reference to certain preferred configurations thereof, other versions are possible. Therefore, the spirit and scope of the disclosure should not be limited to the versions described above.

The foregoing is intended to cover all modifications and alternative constructions falling within the spirit and scope of the disclosure as expressed in the appended claims, wherein no portion of the disclosure is intended, expressly or implicitly, to be dedicated to the public domain if not set forth in the claims.

I claim:

1. A drum lug, comprising:

a base;

a cap rotationally interlocked with said base; and an insert in a hollow inside formed by said base and said cap, said insert preventing rotation of said base and cap relative to one another.

2. The lug of claim 1, wherein said insert fills the hollow inside such that said base, said cap, and said insert form an approximately planar rear of said lug.

3. The lug of claim 1, wherein said base and said cap are interlocked by at least one rotational male-female connection.

4. The lug of claim 1, wherein said base and said cap are interlocked by at least two rotational male-female connections.

5. The lug of claim 4, wherein in a first of said rotational male-female connections, said base comprises a first male piece and said cap comprises a first female piece.

6. The lug of claim 5, wherein in a second of said rotational male-female connections, said cap comprises a second male piece and said base comprises a second female piece.

7. The lug of claim 4, wherein in a first of said rotational male-female connections, said cap comprises a first male piece and said base comprises a first female piece.

8. The lug of claim 3, wherein said rotational male-female connection comprises at least two male pieces and at least two female pieces.

9. The lug of claim 1, wherein said cap comprises two cap apertures each having a diameter of approximately 5/16" or more.

10. The lug of claim 9, wherein said cap apertures are non-circular.

11. A drum lug assembly, comprising:

a drum lug, comprising:

a base;

a cap rotationally interlocked with said base; and an insert in a hollow inside of said drum lug, said insert preventing rotation of said base and cap relative to one another; and first and second receivers, wherein each of said first and second receivers is at least partially in said hollow inside of said drum lug and is at least partially outside of said drum lug.

12. The lug assembly of claim 11, wherein said cap is shaped to define at least two cap apertures, wherein each of said receivers comprises a base and a tube, and wherein each of said tubes protrudes through a respective one of said cap apertures.

13. The lug assembly of claim 11, wherein each of said receivers is approximately 5/8" long or longer, wherein said first receiver is a top receiver and said second receiver is a bottom receiver, and wherein the distance from a top of said first receiver to a bottom of said second receiver is 1.83"±30%.

14. The lug assembly of claim 11, wherein said insert separates said first receiver from said second receiver.

15. The lug assembly of claim 14, wherein said insert comprises a main body and a protrusion, wherein said protrusion separates said first receiver from said second receiver.

16. The lug assembly of claim 11, comprising a first tension rod at least partially through said first receiver, and a second tension rod at least partially through said second receiver.

17. The lug assembly of claim 11, connected to a sidewall of a drum shell.

18. A method of forming a drum lug assembly, comprising:

placing first and second receivers at least partially in a hollow inside of a lug cap and/or lug base;

connecting said lug base and said lug cap so as to sandwich the first and second receivers between the lug base and lug cap;

rotating said lug cap and/or said lug base relative to the other so as to interlock the lug cap and lug base; and placing an insert into a hollow inside formed by said lug base and said lug cap, said insert preventing substantial rotation of said lug base and lug cap relative to one another.

19. The method of claim 18, wherein said placing results in said insert, said lug base, and said lug cap forming an approximately planar rear of said lug.

20. The method of claim 18, wherein said insert substantially fills the remaining hollow inside such that said lug base, said lug cap, and said insert form an approximately planar rear of said lug.

* * * * *